United States Patent [19]

Pollack

[11] Patent Number: 4,470,724

[45] Date of Patent: Sep. 11, 1984

[54] TYING SYSTEM FOR OFFSHORE TERMINAL

[75] Inventor: Jack Pollack, Reseda, Calif.

[73] Assignee: Amtel, Inc., Providence, R.I.

[21] Appl. No.: 424,107

[22] Filed: Sep. 27, 1982

[51] Int. Cl.[3] ..... B63B 21/50

[52] U.S. Cl. ..... 405/211; 114/265; 405/195; 405/224

[58] Field of Search ..... 405/211, 212, 202, 203, 405/204, 195; 114/264, 265, 230, 292, 293

[56] References Cited

U.S. PATENT DOCUMENTS

| | | | |
|---|---|---|---|
| 2,987,892 | 6/1961 | Reeve | 405/227 X |
| 3,237,587 | 3/1966 | Ross | 114/230 |
| 3,407,416 | 10/1968 | Brickhouse | 114/293 X |
| 3,602,174 | 8/1971 | Gorman | 114/293 |
| 3,865,064 | 2/1975 | Van Heijst | 114/230 X |

FOREIGN PATENT DOCUMENTS

| | | | |
|---|---|---|---|
| 560861 | 10/1932 | Fed. Rep. of Germany | 114/230 |

*Primary Examiner*—Dennis L. Taylor

*Attorney, Agent, or Firm*—Freilich, Hornbaker, Rosen & Fernandez

[57] ABSTRACT

A tying arrangement is described for use with an offshore terminal wherein a transfer structure near the sea surface is anchored by a group of anchor lines extending at downward inclines to the sea floor. A bumper line extends between a pair of anchor lines, so a ship heading for the transfer structure first encounters a bumper line that gradually stops it. The bumper line also enables the coupling of anchor lines to transfer energy from one to the other, to increase the energy absorption capacity and stiffness of the system.

5 Claims, 5 Drawing Figures

FIG. 1
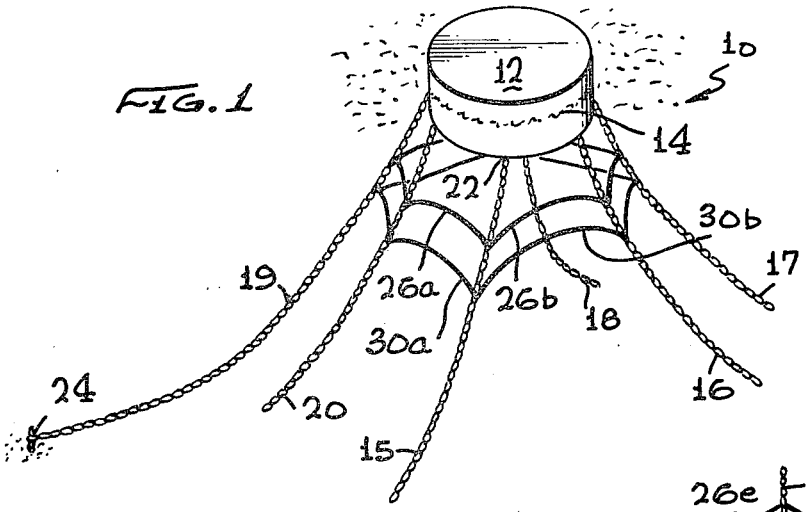
FIG. 3
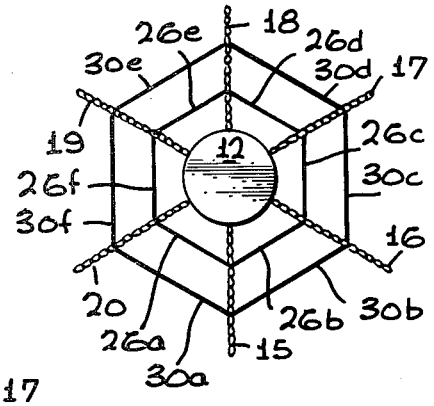
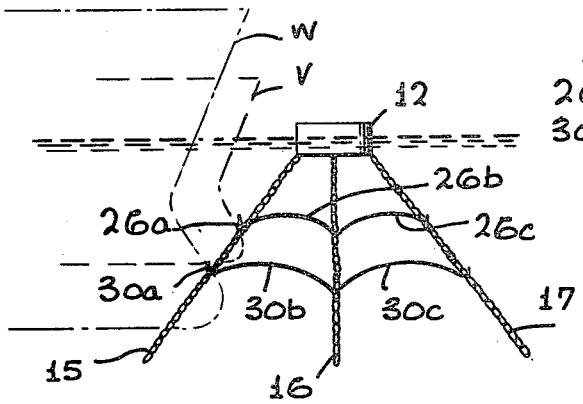
FIG. 2
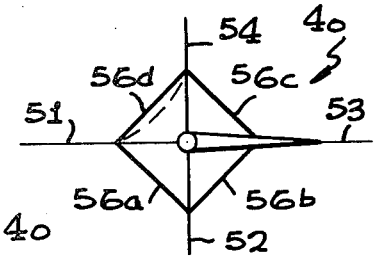
FIG. 5
FIG. 4
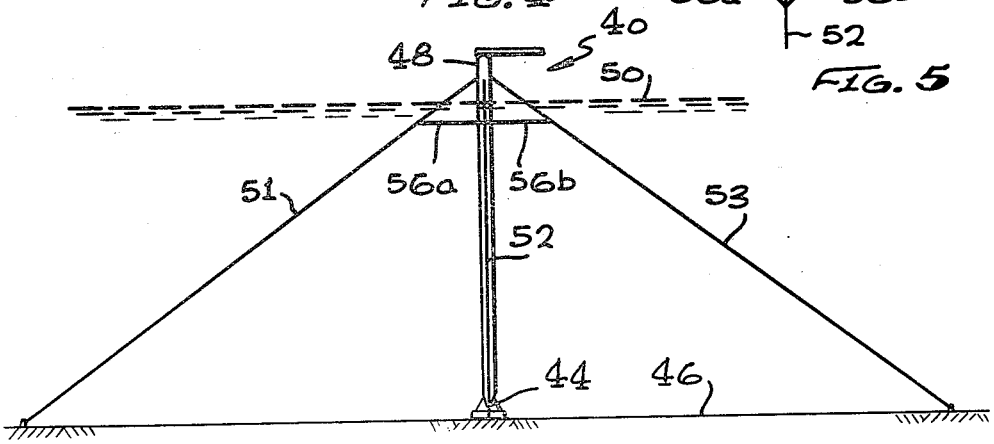

TYING SYSTEM FOR OFFSHORE TERMINAL

BACKGROUND OF THE INVENTION

An offshore terminal can include a transfer structure lying near the sea surface and held in place by a group of anchor lines that extend in different compass directions from the transfer structure and that extend at downward inclines to the sea floor. Since ships come close to the transfer structure, as in making connections to it to moor the ship and/or connect hoses between the ship and transfer structure, there is danger that the ship will hit the transfer structure and damage it. While rubber bumpers can be placed on the outside of the transfer structure, they cannot absorb sufficient shock to avoid damage if a large ship accidentally comes too close to the transfer structure and is thrust against it by the waves. A simple bumper arrangement that could prevent a large ship from accidentally coming too close to the transfer structure, would be of considerable value.

SUMMARY OF THE INVENTION

In accordance with one embodiment of the present invention, a tying arrangement is provided for an offshort terminal, which can be installed at relatively low cost and which is effective in preventing large ships from hitting the transfer structure of the terminal. The transfer structure is of the type that is anchored by a group of anchor lines extending in different compass directions from a transfer structure location near the sea surface, and with each line extending at a downward incline to the sea floor. A bumper line is connected to a pair of the anchor lines to span the region between them, so a ship moving in that region towards the transfer structure will encounter the bumper line before striking the transfer structure. The bumper line, or tying line, also serves to increase the stiffness and energy absorption capacity of the anchor lines.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of an offshore terminal system constructed in accordance with the present invention.

FIG. 2 is a side elevation view of the system of FIG. 1.

FIG. 3 is a plan view of the system of FIG. 1.

FIG. 4 is a side elevation view of a terminal system constructed in accordance with another embodiment of the invention.

FIG. 5 is a plan view of the system of FIG. 4.

DESCRIPTION OF THE PREFERRED EMBODIMENT

FIG. 1 illustrates an offshore terminal system 10 of a type which includes a transfer structure 12 that lies near the sea surface at 14, and that is anchored by a group of anchor lines 15–20. Each line has an upper end 22 attached to a transfer structure location near the sea surface, and a lower end at 24 that is anchored to the sea floor. The particular transfer structure 12 which is shown, is of the type that includes a buoy that floats at the surface. A typical system of this type includes a mooring line (not shown) for attachment to a vessel, and hoses (not shown) for bringing oil or other fluid from an undersea line up through the transfer structure to the moored ship.

The transfer structure 12 can be damaged when hit by a large vessel, as where the vessel accidentally drifts or otherwise closely approaches the transfer structure and is then thrust against it by its own motion or by waves. To prevent such encounter, a bumper arrangement is provided which includes bumper lines such as **26*a* that each extend between a pair of adjacent anchor lines such as 15 and 20 to span the region between them. When a large vessel such as V shown in FIG. 2 approaches the transfer structure 12, the vessel first encounters the bumper line 26*a*. The load of the vessel on the line is absorbed by deflection of the anchor lines 15, 20, by deflecting these lines together. In one example, the transfer structure 12 is 30 feet in diameter and the bumper line 26*a* is horizontally spaced about 15 feet from the transfer structure. The bumper line 26*a* can deflect over a distance of almost 15 feet to absorb the shock of a vessel accidentally headed toward the transfer structure, with the load being absorbed by deflecting the long anchor lines 15, 20**.

In the particular system 10 which has six chain anchor lines 15–20, six bumper lines **26*a*–26*f* can be provided to connect pairs of adjacent anchor lines. Each bumper line lies closer to the surface than the sea floor, and may be attached at substantially the same underwater depth to each of a pair of adjacent anchor lines such as 15, 16**.

The bumper lines such as **26*b* can be formed of chain or dense polymer materials. However, in that case, the bumper line will be negatively buoyant and will lie in a hanging loop, so that its middle is somewhat lower than its opposite ends. With the middle of a bumper line at an increased depth, it will not engage smaller ships. To avoid this, each bumper line such as 26*b*** can be constructed of a positively buoyant material such as polypropelene, so that the bumper line extends in an upwardly-directed loop, wherein its middle is somewhat higher than its opposite ends. A variety of suitable materials such as polypropelene or other polymers are avaiable for use in such lines. Negatively buoyant lines can also be made to float upward by adding buoyancy to these lines.

In many situations, vessels of a large range of drafts may be encountered by a transfer structure. It is desirable to begin stopping a large vessel further from the transfer structure. This can be accomplished by providing a group of additional bumper lines **30*a*–30*f*. Each additional bumper line is tied between a pair of anchor line locations that are further from the transfer structure 12 than the other bumper lines such as 26*b*. FIG. 2 shows how a vessel W with a large draft, will encounter one of the lower bumper lines 30*a*** while it is still spaced a considerable horizontal distance from the transfer structure.

FIG. 4 and 5 illustrate another offshore terminal system 40, which is of a type that includes a tower 42 pivotally mounted at 44 to the sea floor 46 and having a portion 48 lying near the sea surface 50. The tower is also anchored by four anchor lines 51–54 that have upper ends attached to an upper portion 48 of the transfer structure and that extend at a downward incline and in different compass directions to the sea floor. In this particular system, each of the anchor lines such as 51 is of elastic material and neutrally buoyant, as when constructed of a polymer such as nylon. Bumper lines 56a–56d extend between adjacent anchor lines to encounter large vessels before they can hit the transfer structure. The bumper lines can be placed a distance such as 10 feet below the sea surface, so they are not encountered by a small boat that may be sailed to the transfer structure to maintain it. Each of the bumper lines 56a may be made slightly negatively buoyant so their middle does not lie too close to the surface. It may be noted that in the particular terminal system 40, the upper ends of the anchor lines such as 51 are tied to the transfer structure at locations above water, so the bumper lines such as 56a can be placed only a small distance below the sea surface, and still can lie a large distance away from the transfer structure.

The bumper lines which tie a pair of anchor lines together, can be useful in increasing the energy absorption capability of the anchor lines. By tying anchor lines together, the anchor line that is pulled tighter or loosened by the greatest amount as the transfer structure moves, drags another anchor line with it. Accordingly, the anchor line which is dragged along absorbs more energy, and the entire system can absorb more energy and is stiffer. Thus, the bumper lines or tying lines are useful even where their bumper capabilities are not required.

Thus, the invention provides a tying arrangement for an offshore terminal system or other offshore structure, such as a fixed platform, of the type which has a transfer structure portion lying near the sea surface and anchored by several anchor lines extending in different compass directions and at downward inclines towards the sea bottom. The tying arrangement can be constructed at low cost and yet is effective in absorbing large loads from large vessels that tend to approach the transfer structure and in increasing the energy absorption capacity of the system. This can be accomplished by using tying lines that extend between a pair of anchor lines at locations spaced from the transfer structure, so that energy is transferred between anchor lines and so that a vessel sailing between the anchor lines will encounter a bumper line before hitting the transfer structure.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In an offshore system wherein a transfer structure having a portion lying near the sea surface is anchored by a plurality of anchor lines, where the anchor lines extend from the transfer structure portion at a downward incline and in different compass directions toward the sea floor, the improvement of a tying arrangement comprising:

a flexible tying line directly connected between a pair of said anchor lines at locations that are spaced from said transfer structure so they lie below the level of the transfer structure but not directly under it, and are closer to the sea surface than the sea bottom to span the region between the anchor lines, whereby to engage at least deep draft vessels heading toward the transfer structure.

2. The improvement described in claim 1 wherein:

said tying line has a positive buoyance, whereby to increase its height midway between the pair of anchor lines.

3. The improvement described in claim 1 including:

a second tying line connected between said pair of anchor lines at locations further from said transfer structure than the locations where said first mentioned tying line is connected to said anchor lines, whereby to encounter deep draft ships further from the transfer structure.

4. A terminal system for use in a sea, comprising:

a transfer structure having at least a portion lying near the sea surface;

a plurality of anchor lines extending from said transfer structure portion, and at a downward incline and in different compass directions toward the sea floor, and anchored to the sea floor; and a plurality of tying lines, each having opposite ends connected to a pair of said anchor lines at underwater locations that are close enough to the sea surface to span the region between said lines at depths to engage at least deep draft vessels.

5. In an offshore system wherein a transfer structure having a portion lying near the sea surface is anchored by a plurality of anchor lines, where the anchor lines extend from the transfer structure portion at a downward incline and in different compass directions toward the sea floor, the improvement of a bumper arrangement comprising:

a bumper line directly connected to a pair of said anchor lines at locations spaced from said transfer structure but closer to the sea surface than the sea floor, to span the region between the anchor lines so a ship moving in said region toward the transfer structure will encounter the bumper line before striking the transfer structure.

* * * * *